US008292136B2

(12) United States Patent
Tonelli

(10) Patent No.: US 8,292,136 B2
(45) Date of Patent: Oct. 23, 2012

(54) SUPPORT FOR EASIER CARRYING OF SUITCASES, TRUNKS AND THE LIKE

(75) Inventor: Massimo Tonelli, Casalecchio di Reno (IT)

(73) Assignee: G.T. Line S.R.L., Crespellano (IT)

( * ) Notice: Subject to any disclaimer, the term of this patent is extended or adjusted under 35 U.S.C. 154(b) by 610 days.

(21) Appl. No.: 12/458,971

(22) Filed: Jul. 29, 2009

(65) Prior Publication Data

US 2009/0289093 A1 Nov. 26, 2009

Related U.S. Application Data

(63) Continuation-in-part of application No. 11/331,155, filed on Jan. 13, 2006, now abandoned.

(30) Foreign Application Priority Data

Jan. 19, 2005 (IT) ..... BO2005A0028

(51) Int. Cl.
*A45F 3/08* (2006.01)

(52) U.S. Cl. ..... 224/250; 224/576; 224/579; 224/651

(58) Field of Classification Search ..... 224/153, 224/250, 576, 578–579, 651; 190/18 A, 190/27

See application file for complete search history.

(56) References Cited

U.S. PATENT DOCUMENTS

| | | | | |
|---|---|---|---|---|
| 4,223,819 | A * | 9/1980 | Wright | 224/153 |
| 4,236,657 | A * | 12/1980 | Brunton | 224/153 |
| 4,332,379 | A | 6/1982 | Bannister | |
| 4,518,107 | A | 5/1985 | Amos | |
| 5,148,956 | A | 9/1992 | Funk | |
| 5,634,576 | A | 6/1997 | Arbel | |
| 5,803,332 | A | 9/1998 | Thompson | |
| 5,810,223 | A | 9/1998 | Helm | |
| 5,984,154 | A * | 11/1999 | Scicluna | 224/153 |
| 6,216,926 | B1 | 4/2001 | Pratt | |
| 6,347,730 | B1 | 2/2002 | Frederick | |
| D455,009 | S * | 4/2002 | Thayer | D3/327 |
| 6,427,886 | B1 * | 8/2002 | Essex | 224/259 |
| 6,491,196 | B1 | 12/2002 | Coler | |
| 6,530,507 | B2 * | 3/2003 | Oh | 224/153 |
| 6,681,968 | B2 * | 1/2004 | Zwagerman | 224/153 |
| 6,889,882 | B1 | 5/2005 | Leep | |
| 7,004,362 | B2 | 2/2006 | Boone | |
| D531,807 | S * | 11/2006 | Koenig et al. | D3/327 |
| 7,431,311 | B2 * | 10/2008 | Turner et al. | 280/30 |
| 7,568,599 | B2 * | 8/2009 | Hall | 224/250 |
| 8,047,413 | B2 * | 11/2011 | Arajakis | 224/577 |
| 8,118,201 | B1 * | 2/2012 | Calkin | 224/156 |
| 2005/0035616 | A1 | 2/2005 | Davies | |
| 2010/0282790 | A1 * | 11/2010 | Peters et al. | 224/153 |

FOREIGN PATENT DOCUMENTS

| | | |
|---|---|---|
| DE | 3922013 A1 | 2/1990 |
| FR | 2726194 | 5/1996 |
| JP | 2001-243 A | 1/2001 |

* cited by examiner

*Primary Examiner* — Justin Larson
*Assistant Examiner* — John Cogill
(74) *Attorney, Agent, or Firm* — Modiano & Associati; Albert Josif; Daniel J. O'Byrne

(57) ABSTRACT

A support for easier carrying of suitcases, trunks and the like, comprising at least one substantially elongated band, which is provided with elements for fastening at its respective end portions, so that it can be folded onto itself in a loop and closed around at least one suitcase, said band being provided, on at least one face, with elements for detachable coupling to the trunk of the body of the user, so as to allow to carry the suitcase without using one's hands and in a substantially upright position.

11 Claims, 4 Drawing Sheets

SUPPORT FOR EASIER CARRYING OF SUITCASES, TRUNKS AND THE LIKE

This is a continuation-in-part of the U.S. application Ser. No. 11/331,155, filed on Jan. 13, 2006 now abandoned.

BACKGROUND OF THE INVENTION

The present invention relates to a support for the easier carrying of item carrying containers such as suitcases, trunks and the like.

It is known that carrying items by means suitcases, trunks and the like, both in the private field (travel, leisure, et cetera) and in a strictly professional field is often very inconvenient, both due to the weight that one is forced to support with one's arms and due to the fact that at least one hand is in any case constantly engaged. In order to solve this drawback, substantially soft and deformable bags have been provided which are designed to be carried over one's shoulder and rest against the body, adapting to its shape and thus allowing to have one's hands free: however, said bags are not capable of ensuring that the items contained in them remain tidy in the way in which they were introduced, indeed due to the deformations that they undergo during transport.

Suitcases have also been devised which are provided with wheels and with an extensible handle so that they can be pulled like a trolley, so that it is not necessary to support their weight, which is often considerable.

It is evident that the solutions devised up to now are not certainly fully satisfactory, since none of them allows to solve all the described drawbacks: this is particularly felt when the person carrying the suitcase or trunk is engaged in delicate or dangerous operations.

SUMMARY OF THE INVENTION

The aim of the present invention is to obviate the above-cited drawbacks, by providing a support for easier carrying of suitcases, trunks and the like, which allows to bear the weight of the suitcase without excessive efforts and at the same time allows to have one's hands and arms completely free.

Within this aim, an object of the present invention is to provide a support for easier carrying of item carrying containers, such as suitcases, trunks and the like which is extremely versatile and flexible in use and has a very low weight.

Another object of the present invention is to provide a support which is simple, relatively easy to provide in practice, safe in use, effective in operation, and has a relatively low cost.

This aim and these and other objects which will become better apparent hereinafter are achieved by the present support for easier carrying of suitcases, trunks and the like, characterized in that it comprises at least one substantially elongated band, which is provided with means for fastening at its respective end portions, so that it can be folded onto itself in a loop and closed around at least one suitcase, said band being provided, on at least one face, with elements for detachable coupling to the trunk of the body of the user, so as to allow to carry the suitcase without using one's hands and in a substantially upright position.

BRIEF DESCRIPTION OF THE DRAWINGS

Further characteristics and advantages of the present invention will become better apparent from the following detailed description of a preferred but not exclusive embodiment of a support for easier carrying of item carrying containers, such as suitcases, trunks and the like according to the invention, illustrated by way of non-limiting example in the accompanying drawings, wherein.

DESCRIPTION OF THE PREFERRED EMBODIMENTS

In the exemplary embodiment that follows, individual characteristics may actually be interchanged with other different characteristics that exist in other embodiments.

Moreover, it is noted that anything found to be already known during the patenting process is understood not to be claimed and to be the subject of a disclaimer.

Figure 1:
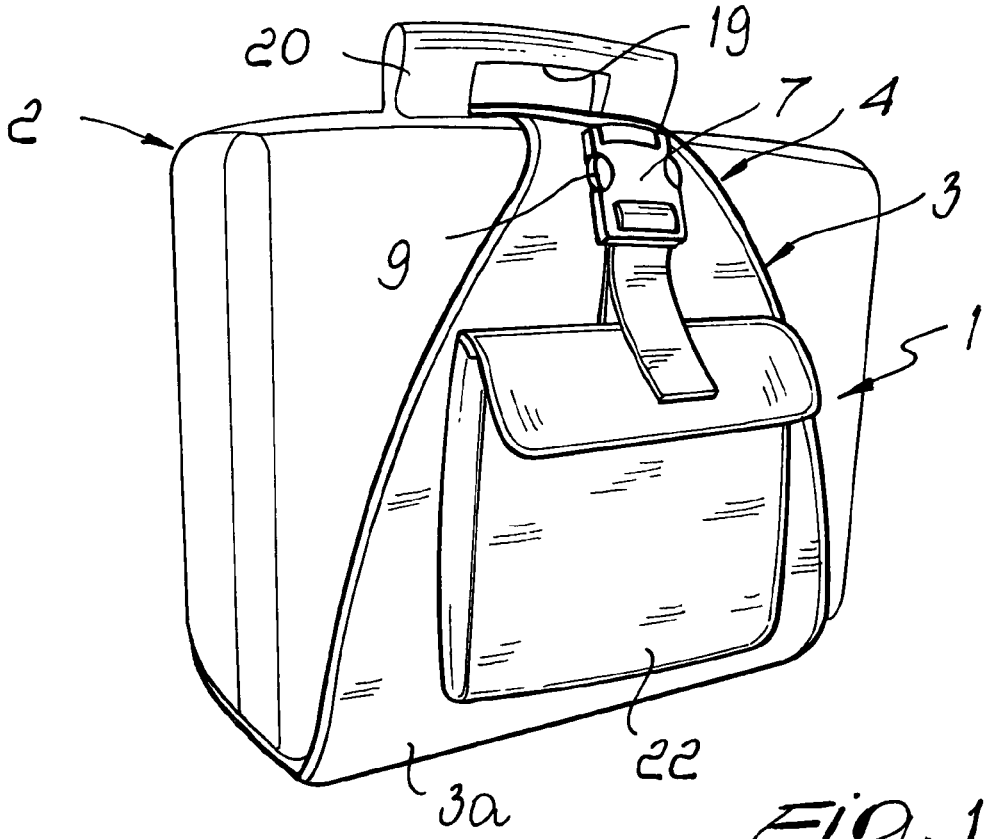
FIG. 1 is a front perspective view of the support according to the invention, associated with a suitcase.

With reference to FIG. 1, the reference numeral 1 generally designates a support for easier carrying of an item carrying container, such as suitcases, trunks and the like according to the invention.

Figure 2:
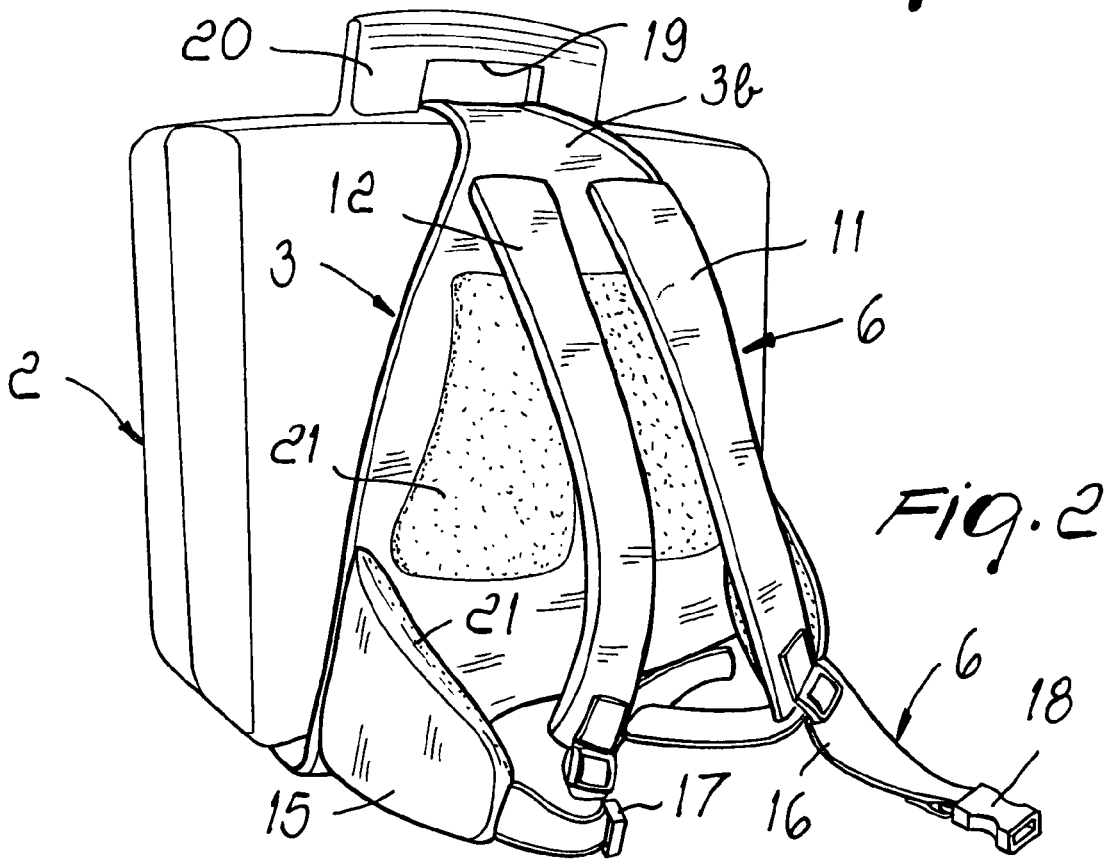
FIG. 2 is a rear perspective view of said support associated with the suitcase.

FIGS. 1 and 2, in particular, show a support 1 according to the invention which is associated with a suitcase, designated by the reference numeral 2, of a substantially traditional type, but this is done merely by way of example. It is in fact evident that the support described hereinafter can be associated simply with any type of portable carryall container having the most disparate sizes (for example a trunk, a box, and the like).

Figure 3:
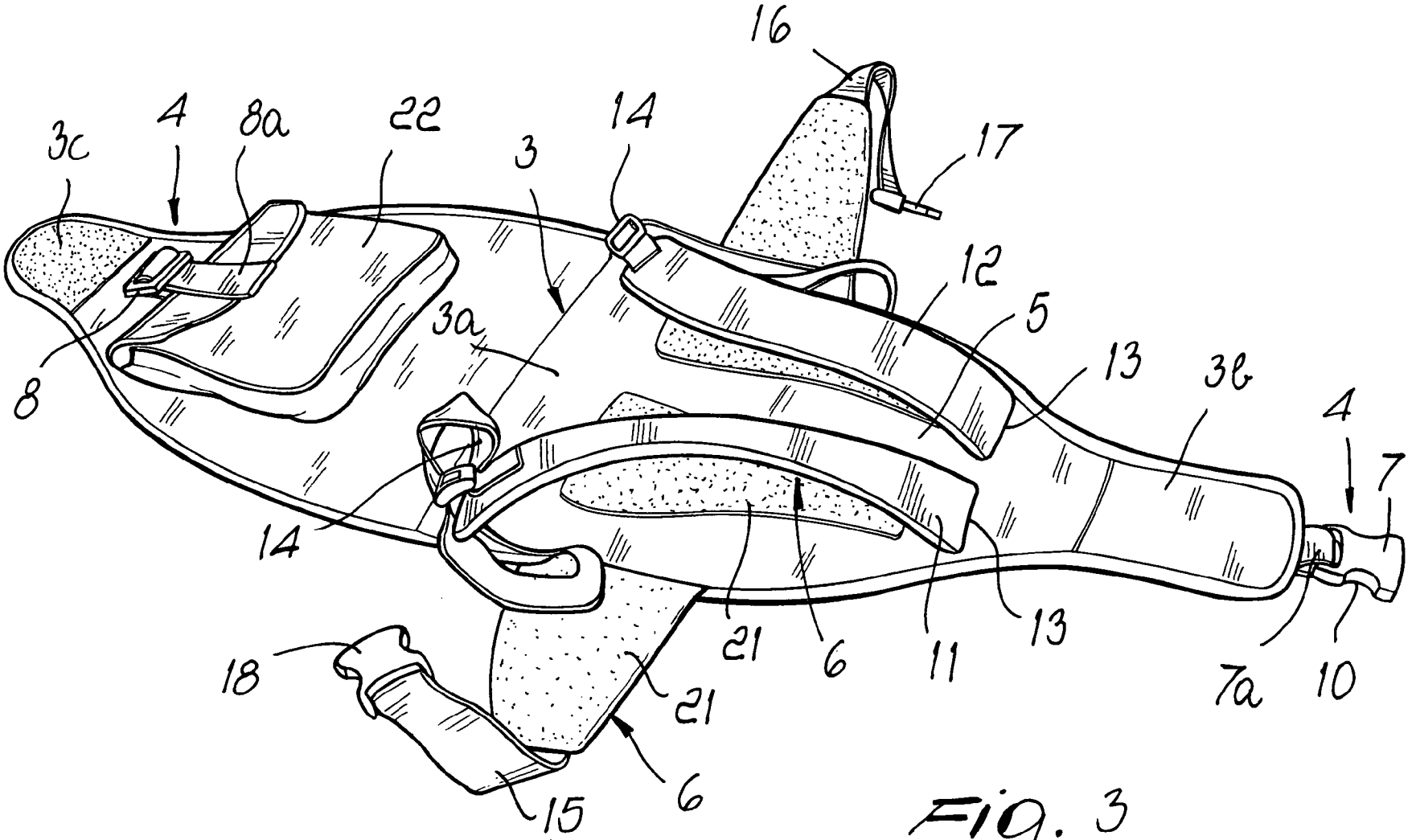
FIG. 3 is another perspective view of the support.

The support according to the invention comprises at least one substantially elongated flexible band 3, which forms a central portion 3*a* and two end portions 3*b*, 3*c* (FIG. 3). The band 3 is provided advantageously with fastening means, generally designated by the reference numeral 4, at the end portions 3*b*, 3*c*, so that it can be easily folded onto itself in a loop and closed around the suitcase 2. The band 3 further comprises, on at least one face 5, elements, generally designated by the reference numeral 6, for detachably coupling to the trunk of the body of the user, so as to be able to carry the suitcase 2 without using one's hands and in a substantially upright position. This clearly avoids excessive tiring of the user (who often, in performing his profession, must walk for long stretches) and allows said user to perform any operation with his hands and arms free.

Conveniently, the band 3 and the detachable coupling elements 6 are made of a material which is substantially flexible, so that it can be folded easily, and is very light and strong, for example natural fabric or synthetic fabric or any other material which has the characteristics cited above and is in any case relatively inexpensive.

The fastening means 4 conveniently comprise a first buckle, which is constituted by a female member 7 and a male member 8, which is suitable to engage substantially with a snap action in the female member 7; the female member 7 and the male member 8 are associated, so that their position can be adjusted, with respective strips 7*a*, 8*a*, which are rigidly coupled to the end portions 3*b*, 3*c* of the band 3. In particular, the male member 8 is provided with elastically flexible tabs 9, which are suitable to engage within respective recesses 10 provided in the female member 7, so as to provide the removable loop-like closure of the band 3 around the suitcase 2.

Conveniently, the detachable coupling elements 6 comprise at least one pair of substantially parallel belts 11, 12 of the over-the-shoulder type, i.e., each suitable to be arranged around a respective shoulder of the user; the belts 11, 12 are fixed to the central portion 3*a* of the band 3 at respective mutually opposite ends 13, 14. Preferably, each one of the belts 11, 12 is of the type whose length can be adjusted, used in conventional rucksacks, so that it is possible to adapt the configuration of the support to the needs of each user.

Conveniently, the coupling elements 6 also comprise at least one pair of lower mutually opposite straps 15, 16, which are fixed, each at a respective end, to the sides of the central portion 3*a* of the band 3 and can be coupled to each other by means of a second buckle, which is constituted by a male element 17 and a female element 18, preferably of the type of the first buckle described above. The lower straps 15, 16 thus allow to fix the band 3 to the trunk of the body of the user substantially at the height of his waist belt.

The band 3 is conveniently shaped so as to close substantially like a belt transversely around the suitcase 2, so as to pass below the hand insertion opening 19 formed by the handle 20 of the suitcase 2: safe retention of the suitcase 2 is thus ensured and lateral slippage thereof, or any other inadvertent displacement thereof, is prevented.

In greater detail, the band 3 has a substantially wide contour at the central portion 3*a*, so as to provide a large supporting base for the suitcase 2, and has a substantially narrow and tapered contour at the end portions 3*b*, 3*c*, so as to easily fit below the insertion opening 19 of the handle 20.

Conveniently, the band 3 and the coupling elements 6 (the belts 11, 12 and the lower straps 15, 16) are provided with respective paddings 21, which are suitable to make it more comfortable to carry the suitcase 2 over one's shoulder.

The band 3 is provided preferably with at least one external carryall pocket 22, which is rather useful for carrying other items which have to be accessed quickly.

Figure 4:
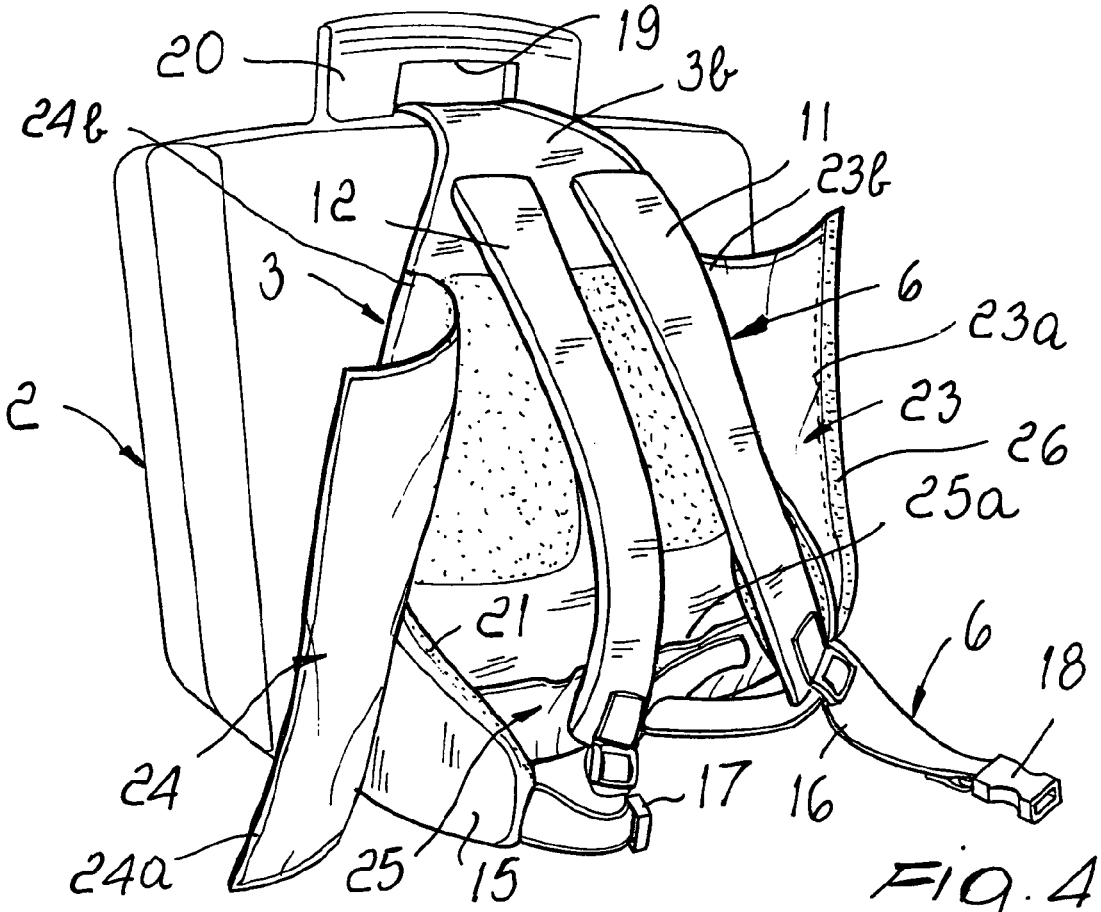
FIG. 4 is a perspective view of the support according to the invention, in a further embodiment and, in a use configuration.
Figure 5:
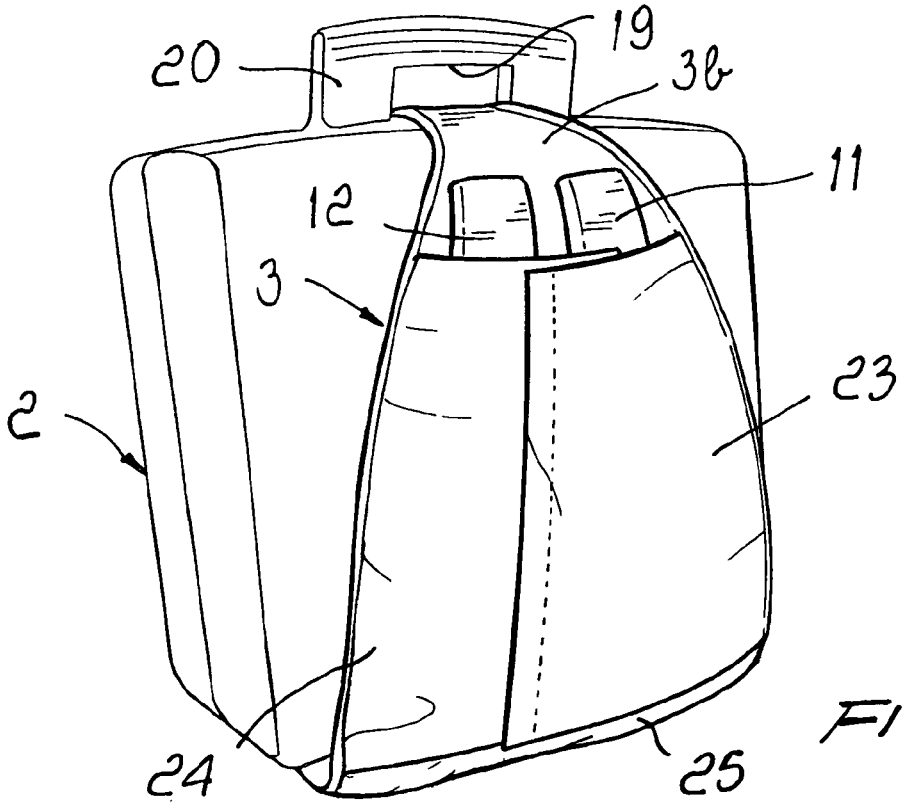
FIG. 5 is a perspective view of the support according to the invention of FIG. 4, in a different use configuration.
Figure 6:
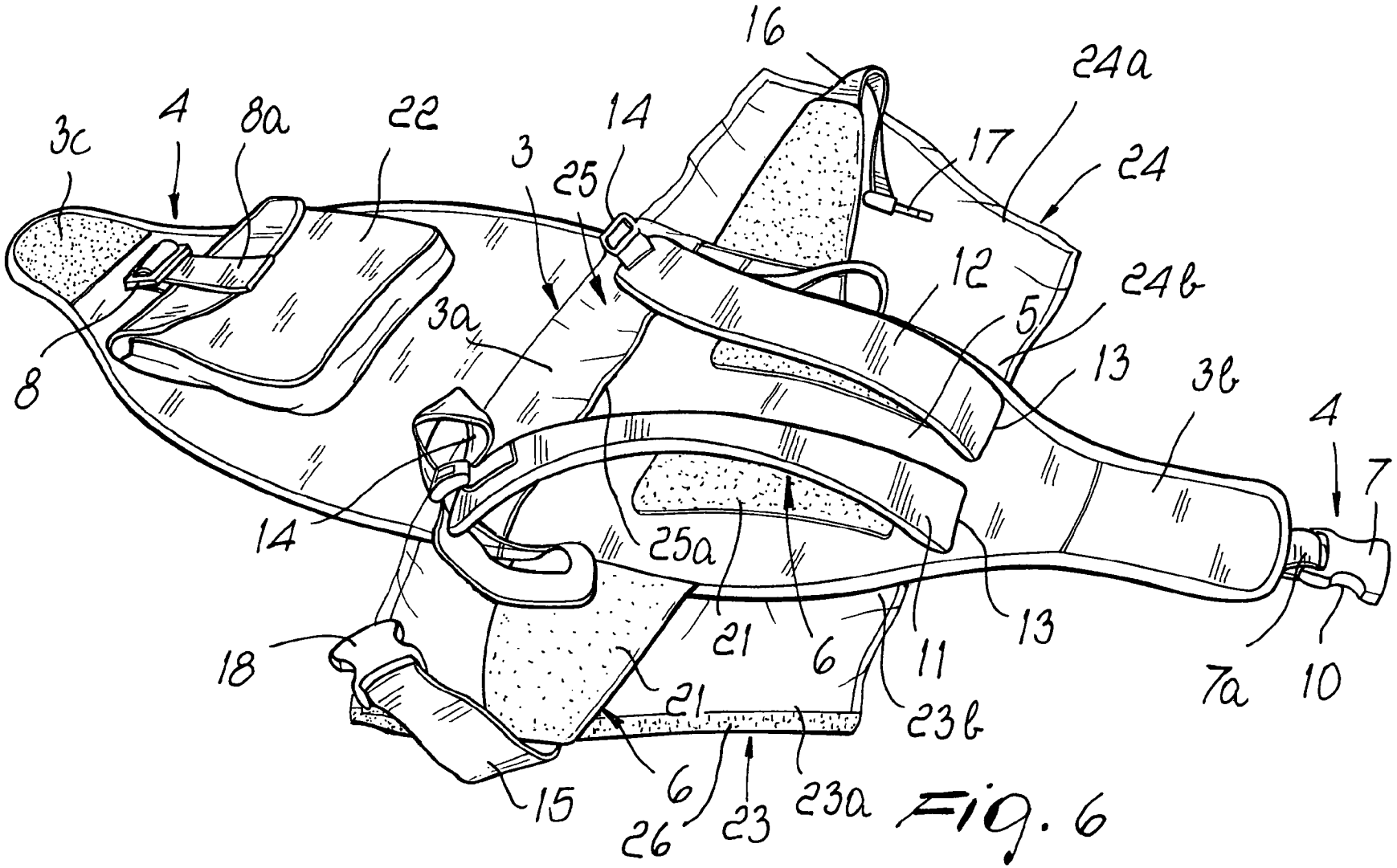
FIG. 6 is another perspective view of the support according to the invention of FIG. 4.

In a further embodiment of the invention, shown in FIGS. 4-6, the support for easier carrying of item carrying containers is provided with two flaps 23, 24 of flexible material that comprise each a first, attaching side end 23*b*, 24*b* and a second, opposite, free side end 23*a*, 24*a*.

The two flaps 23, 24 are attached with the first side ends 23*b*, 24*b* to the face 5 of the band 3, preferrably at respective side regions of its central portion 3*a*. In this attachment configuration, the two flaps 23, 24 can be folded to an open position in which they are folded open, leaving free the belts 11, 12 for use of the support, for example as a backpack. The flaps 23, 24 can also be unfolded to a closed position in which their second free side ends 23*a*, 24*a* can be drawn together so as to cover and keep hidden the belts 11, 12 forming the detachable coupling elements 6 and enable use of the support, for example as a carryall, or easy storing in a compact configuration.

As the one skilled in the art would understand, it is possible to provide only one first flap 23 of flexible material that is attached with its first attaching side end 23*b* on the face 5 of the band 3, exactly as shown for the flap 23 in FIGS. 4-6 and a second, opposite, free side end 23*a*.

The only one flap 23 will only have a bigger width, suitable to cover all the central portion 3*a* of the band 3, where the belts 11, 12 are located, and it will be foldable and unfoldable exactly as described above for the two flaps 23, 24. In the closed configuration the second free end 23*a* can be fastened to the opposite side of the band 3.

The two flaps 23, 24 can also be attached with their attaching ends transverse to the central portion 3*a*.

The support conveniently comprises a third flap 25, attached on the face 5 of the band 3. In the illustrative example of FIGS. 4-6 the third flap 25 is attached with a first side end to a peripheral region of the central portion of the band 3, crosswise with respect to the two flaps 23, 24. The third flap 25 has its further, opposite side end 25*a* free, so as to form a pocket in which the pair of lower straps 15, 16 of the detachable coupling elements 6 can be accommodated in a stored position. The two flaps 23, 24 can then be drawn over for closing over the belts 11, 12 as described above.

The two flaps 23, 24 are provided at the free side ends 23*a*, 24*a* with fastening elements 26, suitable to fasten to each other the respective free side ends 23*a*, 24*a* in the closed position.

The fastening elements shown in FIGS. 4-6 are hook-and-loop patch elements, such as those known with the name Velcro®. It is also possible to provide other suitable fastening elements, such as snap buttons, zippers or hook-and-eye fasteners.

The method of use of the support according to the invention is intuitive. It is in fact sufficient to wrap the band 3 around the suitcase 2, as shown in FIGS. 1 and 2, and insert with a snap action the male member 8 in the female member 7 of the first buckle (optionally adjusting the position thereof with respect to the strips 7*a*, 8*a*), providing the optimum locking of the suitcase 2 to the band 3.

For the embodiment of FIGS. 4-6, the flaps 23, 24, 25 can be further operated to be left open or closed as described.

It has thus been shown that the invention achieves the intended aim and objects. The support allows to carry, very simply and easily, even very heavy and bulky suitcases in an upright position without excessive tiring and with one's hands completely free. The support is very light and strong, and can also be folded up when not in use, with minimal space occupation.

The invention thus conceived is susceptible of numerous modifications and variations, all of which are within the scope of the appended claims.

All the details may further be replaced with other technically equivalent ones.

The embodiment of the present invention shall be carried out in the most scrupulous compliance with the statutory and regulatory provisions related to the products of the invention or correlated thereto and following any required authorization of the corresponding competent authorities, with particular reference to regulations related to safety, environmental pollution and health.

In practice, the materials used, as well as the shapes and the dimensions, may be any according to requirements without thereby abandoning the scope of the protection of the appended claims.

The disclosures in Italian Patent Application No. BO2005A000028 from which this application claims priority are incorporated herein by reference.

What is claimed is:

1. A support for easier carrying of item carrying containers, comprising: at least one elongated band made of a flexible material that allows folding of the band onto itself in a loop, said band including a central portion and two end portions, at least a first one of said end portions having a narrow contour region suitable to fit below a hand insertion opening formed by a handle element of an item carrying container; fastening means provided connected to said band for fastening to each other said end portions when the band is folded onto itself in a loop and closed around at least one container; detachable coupling elements provided on at least one face of said band for detachable coupling to a trunk of a body of a user, so as to allow to carry the container without using hands and in a substantially upright position; two flaps of flexible material that comprise each a first, attaching side end and a second, opposite, free side end, said two flaps being attached with said first side ends thereof to the at least one face of the band so as to be both foldable to an open position in which the flaps are folded open and unfoldable to a closed position in which the second free side ends of the flaps are drawable together so as to cover and keep hidden said detachable coupling elements; and a third flap, attached on said at least one face, of said band, said detachable coupling elements comprising at least one pair of straps which are mutually opposite and are provided at sides of said central portion of said band, said third flap being attached to said band so as to form a pocket suitable to accommodate said at least one pair of straps, in a stored position.

2. The support of claim 1, wherein said fastening means comprises at least one first buckle, which is constituted by a female member and by a male member, said female and male members being rigidly coupled to respective ones of said end portions, and wherein said male member is provided with elastically flexible tabs, which are suitable to engage in respective recesses provided in said female member, so as to provide detachable loop-like closure of said band around the at least one container.

3. The support of claim 2, wherein said detachable coupling elements comprise at least two belts, which are substantially parallel and of an over-the-shoulder type, each said belt being fixed to a central portion of said band at respective mutually opposite ends thereof.

4. The support of claim 3, comprising a second buckle, said detachable coupling elements comprising at least one pair of side straps which are mutually opposite, are provided at sides of said central portion of said band and are provided, at respective free ends thereof; with the male member and the female member of the second buckle, so as to surround the trunk of the body of the user substantially at a height of a waist belt of the user.

5. The support of claim 4, wherein said band is provided with at least one external carryall pocket.

6. The support of claim 3, with a container with a handle, wherein said band has a contour which is suitable to be closed substantially like a belt transversely around the container and arranged so as to pass below a hand insertion opening formed by the handle, so as to ensure safe retention of said container, preventing lateral slippage thereof or any other inadvertent movement.

7. The support of claim 6, wherein said band has a substantially wide contour region at said central portion, so as to provide a broad base for supporting the container, and a substantially narrow contour region at both said end portions, so as to fit below the hand insertion opening formed by the handle of the container.

8. The support of claim 2, wherein said female and male members are associated with respective strips so as to have an adjustable position therealong, said strips being rigidly coupled to said end portions.

9. The support of claim 1, wherein said band and said detachable coupling elements are made of flexible, lightweight and strong material.

10. The support of claim 1, wherein said band and said detachable coupling elements are provided with paddings which are suitable to make the support more comfortable to carry the container on one's shoulders.

11. The support of claim 1, wherein said at least first one of said end portions having a narrow contour region has an extension such as to allow passing, thereof below a hand insertion opening formed by a handle element of an item carrying container and to allow a further, at least partial, overlapping thereof over the second one of said end portions, said fastening means being provided connected to said band so as to fasten to each other said end portions when in said at least partial overlapping when the band is folded onto itself in a loop and closed around at least one container.

* * * * *